United States Patent [19]

Gooden

[11] Patent Number: 4,538,972

[45] Date of Patent: Sep. 3, 1985

[54] BOOTSTRAP RESERVOIR

[75] Inventor: Richmond A. Gooden, Kettering, Ohio

[73] Assignee: United Aircraft Products, Inc., Dayton, Ohio

[21] Appl. No.: 566,888

[22] Filed: Dec. 30, 1983

[51] Int. Cl.[3] ..... F04B 11/00

[52] U.S. Cl. ..... 417/540; 138/31; 165/104.31

[58] Field of Search ..... 417/540; 138/31; 237/66; 165/104.31

[56] References Cited

U.S. PATENT DOCUMENTS

| | | | |
|---|---|---|---|
| 3,074,437 | 1/1963 | Mercier | 138/31 |
| 3,230,977 | 1/1966 | Mercier | 138/31 |
| 3,559,727 | 2/1971 | Hill et al. | 138/31 |
| 3,677,334 | 7/1972 | Bathla et al. | 138/31 |
| 4,067,381 | 1/1978 | Lord | 62/129 |
| 4,187,682 | 2/1980 | Shen | 138/31 |
| 4,376,619 | 3/1983 | Haushalter et al. | 417/540 |
| 4,388,052 | 6/1983 | Falendysz, Sr. et al. | 417/540 |

FOREIGN PATENT DOCUMENTS

| | | | |
|---|---|---|---|
| 2742331 | 5/1978 | Fed. Rep. of Germany | 417/540 |

*Primary Examiner*—Carlton R. Croyle
*Assistant Examiner*—Donald E. Stout
*Attorney, Agent, or Firm*—J. E. Beringer

[57] ABSTRACT

In a liquid coolant circulating or like system an accumulator—reservoir device of the bootstrap type. The reservoir device has a sliding seal construction, in which a piston is subject to high and low pressure influences as these relate to discharge and intake sides of a liquid circulating pump. External leakage from the device is minimized by an arrangement avoiding the need to seal against high pressure loss direct to ambient. Overall length is reduced by the arrangement which places a high pressure chamber between low pressure chambers. A hollow piston construction permits packaging system components within the reservoir, introducing further opportunity for simplicity and compactness of design.

5 Claims, 4 Drawing Figures

FIG-1
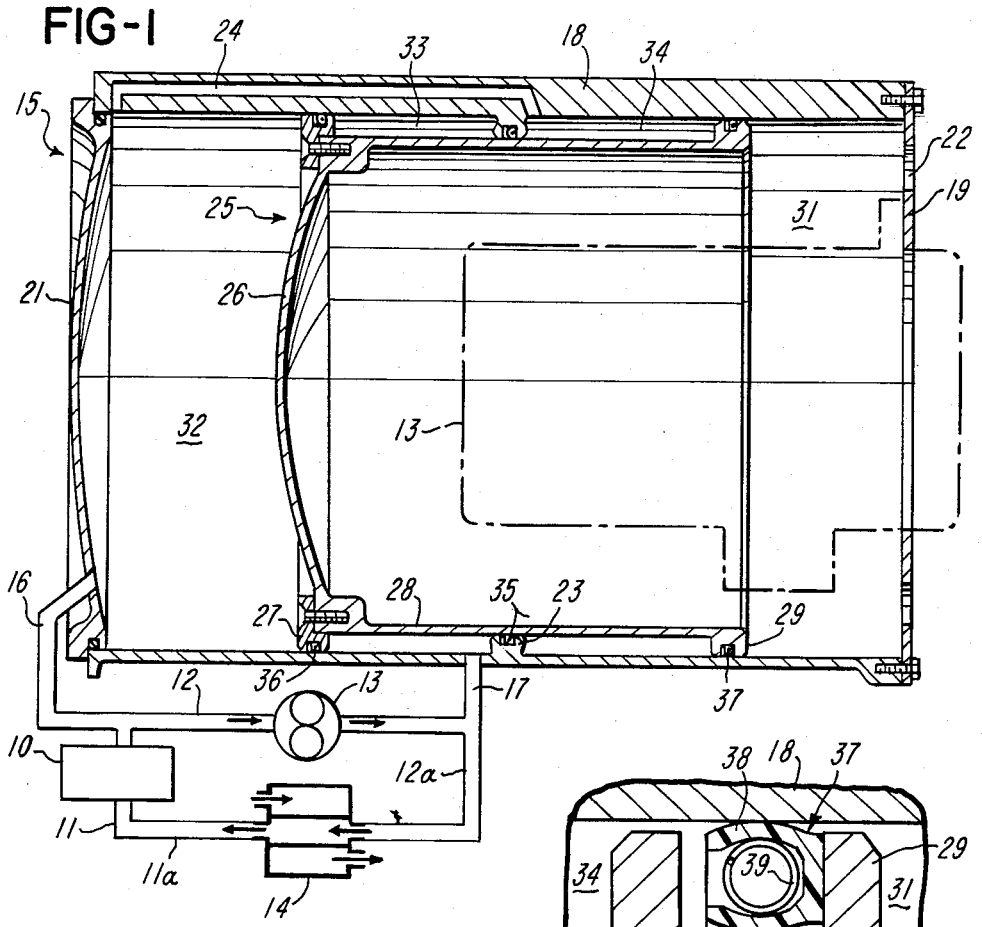
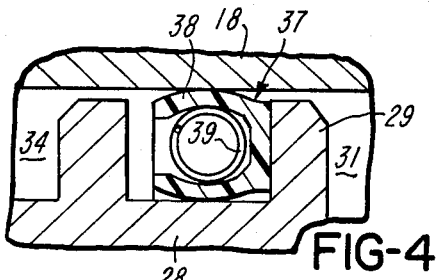
FIG-4
FIG-2
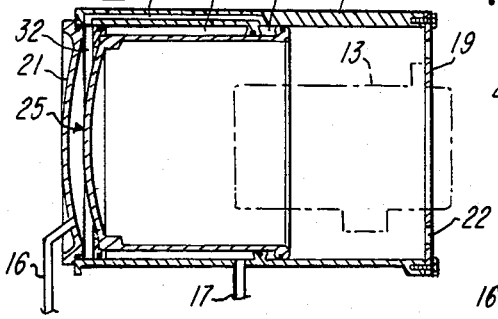
FIG-3
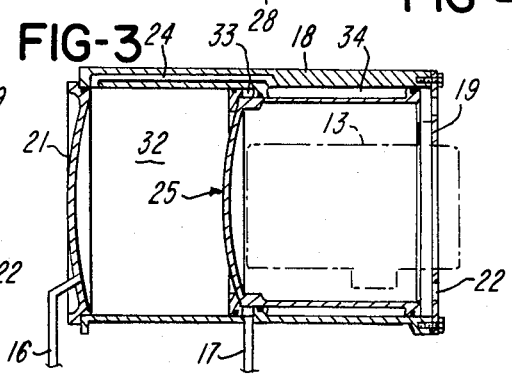

BOOTSTRAP RESERVOIR

BACKGROUND OF THE INVENTION

1. Field of the Invention

This invention relates to closed liquid coolant circulating and like systems, and particularly to such systems as they incorporate an accumulator-reservoir device of the bootstrap type.

2. Description of the Prior Art

An accumulator-reservoir device in a closed liquid circulating system exists to serve several purposes, as follows:

(a) To provide a positive pressure to the suction (intake) side of the liquid circulating pump;

(b) To accommodate changes in system liquid volume caused by changes in liquid temperature; and (c) To provide a reserve of liquid, compensating for minor system leakage.

Known types of accumulator-reservoir devices include a piston in a cylinder mechanism defining an expansible chamber communicating with the circulating system at the suction side of the pump. In one instance this mechanism includes a spring to power the piston to maintain a pressure on the liquid in the expansion chamber. In another instance, the device is of the "bootstrap" type, that is, the piston is powered by fluid pressure from the discharge side of the pump. An example of the former construction is found in Hill, et al U.S. Pat. No. 3,559,727, issued Feb. 2, 1971. An example of the latter construction is found in Haushalter, et al U.S. Pat. No. 4,376,619, issued Mar. 15, 1983.

This invention relates to the bootstrap type device, and especially to constructions which while relatively more simple and inexpensive than prior art devices are able to meet stringent leakage and size limitations. The structure of patent No. 4,376,619 provides a chamber where high pressure liquid admitted from the discharge side of the pump acts on the piston to exert a continuing pressure on relatively low pressure liquid in the expansion chamber. The high pressure chamber is sealed from communication with ambient surroundings by a diaphragm stretched across one end of the cylinder and flexing with piston movements. The diaphragm is in large part used because it is a very effective seal against high pressure, there being some system applications for an accumulatorreservoir device having an extremely low tolerance for leakage. A diaphragm construction is, however, relatively expensive. Its flexing action can lead to excessive wear, and, usually, a cylinder extension must be provided to accommodate such flexing motion. It has been suggested that the diaphragm construction could be replaced by a sliding seal construction. However, presently known O-ring and like seals, mounted in the piston periphery or in the cylinder wall, impose an inadequate control over escape to ambient of liquid from the high pressure chamber.

The foregoing comprises a full account of pertinent prior art insofar as it is now known to the applicant and to others substantively involved in the preparation of this application.

SUMMARY OF THE INVENTION

The present invention has in view a bootstrap reservoir of the sliding seal type in which leakage problems are minimized, and without a use of special seals. In addition, and for given design conditions, a practice of the invention reduces overall length of the device. Still further, and through a use of a particular piston configuration and avoidance of cylinder extensions. the pump may be effectively mounted within the cylinder, again adding to the compactness and simplicity of the device design.

In carrying out these objectives and purposes, a bootstrap reservoir of an illustrated embodiment of the invention comprises a cylinder and a relatively reciprocable piston therein defining at one end of the cylinder an expansion chamber, an opposite end of the cylinder communication with ambient surroundings. The piston is hollow and an end exposed to ambient is open so that a pump mounted to extend into the cylinder can be telescopically received in the piston. An internally projecting annulus on the cylinder cooperates with flange portions on the piston exterior to define longitudinally spaced apart annular pressure chambers, the annulus serving as a common reactant member for fluid pressure in the chambers. A seal in the flange portion between the expansion chamber and a first or more nearly adjacent pressure chamber denies communication between these chambers. A seal in the annular reactant member denies intercommunication between the annular pressure chambers. A seal in the flange portion between what may be regarded as a second or more remote pressure chamber and ambient surroundings denies communication of this chamber with ambient. The described first or more nearly adjacent pressure chamber accordingly occupies an intermediate position between the expansion chamber and the second or more remote pressure chamber.

In connecting the reservoir device into the system, the expansion chamber is communicated with the system on the suction side of the pump and the first or intermediately positioning pressure chamber is communicated with the system on the discharge side of the pump. Further, the construction provides for pressure fluid communication between the expansion chamber and the second or more remote pressure chamber in by-passing relation to described seals. The first or intermediate chamber is, therefore, a high pressure chamber. The expansion chamber and second or more remote pressure chamber are areas of relatively low pressure. The high pressure chamber has no direct communication with ambient surroundings. Leakage, if any, therefrom is into low pressure chamber and from these back into the system on the suction side of the pump. Moreover, the existence of the second, low pressure, chamber provides added piston area in the manner to permit a reduced pump-reservoir package length.

An object of the invention is to provide a closed liquid circulating system with an included bootstrap reservoir substantially as in the foregoing.

Other objects and structural details of the invention will appear from the following description when read in connection with the accompanying drawings, wherein:

FIG. 1 is a view in partly diagrammatic form, showing a liquid circulating system incorporating a bootstrap reservoir in accordance with an illustrated embodiment of the invention, parts being shown in a position they may assume at normal or moderate operating temperatures;

FIG. 2 is a reduced scale view of the reservoir device of FIG. 1, parts being shown in a position substantially as assumed under low temperature operating conditions;

FIG. 3 is a view like FIG. 2 showing parts as they appear under high temperature operating conditions; and FIG. 4 is a fragmentary relatively enlarged view of a sliding seal portion of the reservoir device. Referring to the drawing, the illustrated system circulates liquid coolant for cooling purposes, as for example to cool electronic equipment in aircraft. The system circulates an appropriate liquid coolant through the electronic equipment or other heat producing source where it absorbs generated heat. From the heat source, the coolant is directed to the cooling system where heat is rejected in a suitable heat transfer device to air, other liquid or to some other medium acting as a heat sink. The coolant is then returned to the heat source where it absorbs additional heat and is again returned for cooling, the process involving a closed flow circuit in which the pump, while operating, maintains continuous pressure on and continuous circulation of the flowing coolant.

As indicated in the diagrammatic illustration of FIG. 1, liquid coolant is directed to a heat source 10 by way of a conduit 11 and returns therefrom by way of a conduit 12. The latter extends to the suction or inlet side of a pump 13, the discharge or outlet side of which is connected by a conduit extension 12*a* to one side of a heat exchanger 14. Within a heat exchanger 14, the coolant is brought into heat transfer relation to another, relatively cooler fluid and is continuously directed through and beyond the heat exchanger by conduit means 11*a* leading to and forming a part of conduit 11. The flowing system may include other components, as for example a valve controlled bypass around the heat exchanger 14.

An accumulator-reservoir device 15 is placed in commmunication with the fluid flowing system by way of conduits 16 and 17 connecting in the system respectively at inlet and outlet sides of the pump 13. The device 15 provides interior space to accommodate expansion of the coolant when increasing fluid temperature brings about a decreasing density thereof. Also, pressure applying means within the accumulator device maintains pressure in the system. An increasing density of the coolant thus will not allow the pump suction pressure to fall below the desired value, since whatever loss of pressure occurs is compensated for by movement of the pressure applying means. The attainment of pressure values within the accumulator-reservoir device higher than a selected predetermined value may be obviated by the provision of pressure relief means (not shown).

In accordance with concepts of the present invention, the accumulator-reservoir device 15 is a device of the bootstrap type, that is, one in which the energizing pressure for operation of the device has it sources in the pump 13.

Considering the device 15 in its illustrated form, which is at least in part a diagrammatic representation, it includes an open ended cylinder 18. Plates 19 and 21 suitably attach to and close ends of the cylinder body. Plate 19 is apertured, as diagrammatically indicated at 22, to communicate one end of the cylinder interior with ambient surroundings. The plate 19 serves also as a mount for the pump 13 which, as indicated, is accommmodated within the cylinder 18. Substantially midway between its ends, cylinder 18 is formed with an interiorly projecting annulus 23. Further, from a location immediately adjacent end plate 21 to a location beyond annulus 23, in the direction of end plate 19, the cylinder has an integrally formed passageway 24. Cylinder interior spaces connected by passageway 24 are in communication with one another.

A piston 25 is relatively reciprocably received in cylinder 18. It comprises a generally transverse end wall 26 to which is fixed an annular flange 27 in approximate sliding contact with the interior wall of cylinder 18. The piston further has a skirt or cylindrical body portion 28 projecting toward end plate 19 and terminating in a flange 29. The skirt 28 has a diameter to have an approximate sliding fit in annulus 23, and flange 29 has a diameter, like that of flange 27, to have approximate sliding contact with the interior wall of cylinder 18. Together, the flanges 27 and 29 and annulus 23 provide longitudinally spaced bearing supports for the piston 25 in its relatively reciprocable movements in the cylinder. The piston 25 accordingly is a relatively hollow body, closed at one end by transverse wall 26 and open at its opposite end to accommodate the presence of interiorly mounted system component 13. The hollow interior of the piston 25 to the right of piston wall 26 as seen in the drawings, cooperates with end plate 19 in defining a cylinder interior chamber 31 open through apertures 22 to ambient surroundings. Piston wall 26 on its opposite side cooperates with end plate 21 in defining a closed chamber 32. Piston skirt 28 is, by reason of projecting flanges 27 and 29, in a concentric spaced relation to cylinder 18. With the cylinder, and with flanges 27 and 29 and with annulus 23, it defines annular closed chambers 33 and 34 respectively to the left and to the right of annulus 23 as seen in the drawings.

As diagrammatically shown in FIG. 1, passageway 16, communicating with the system on the suction side of pump 13, opens into chamber 32 of the reservoir device. Passageway 17, communicating with the system on the discharge or pressure side of the pump, opens into annular chamber 33. By reason of the difference in involved system pressures, chamber 32 can be designated a chamber of low pressure and chamber 33 a chamber of high pressure. Since passageway 24 intercommunicates chambers 32 and 34, the latter may likewise be designated a chamber of low pressure.

For a more positive separation of reservoir pressures, there is installed in the periphery of annulus 23 a seal 35 and in the peripheries of flanges 27 and 29 respective seals 36 and 37. The seals 35–37 are mounted in grooves in their respective seating surfaces and are compressed by the opposing cylinder wall surface substantially to deny a flow of pressure fluid thereby. The seals art provides numerous examples of dynamic or sliding seals suitable for present use. In the illustrated instance, as seen in FIG. 4, each comprises a resilient, deformable member 38 urged by an interior spring 39 and by controlled pressure fluid outward into contact with an opposing wall surface. A somewhat exaggerated relationship of parts is shown in FIG. 4, for illustration purposes. The ability of a seal structure such as the one shown to seal opposing piston and cylinder surfaces with relatively low frictional resistance to sliding motion will be obvious.

From the foregoing description, and from the illustrated relationship of piston area, operation of the accumulator-reservoir device and of the system in which it appears will be largely self-evident. Briefly, however, operation of the system at what may be regarded as a normal or intermediate temperature finds the piston 25 positioned substantially as shown in FIG. 1. Pump discharge pressure, as reflected in chamber 34 reacts against annulus 23 and is applied to flange 27 in a manner to pressurize the liquid in chamber 32. Such pressure, with chamber 32 acting as an expansion chamber, acts to: (a) insure a continuous supply of liquid under pressure to the intake or suction side of the pump; (b) accommodate changes in system liquid volume caused by changes in liquid temperature; and (c) provide a reserve of liquid compensating for minor system leakage. A lowering liquid temperature, leading to a more dense liquid condition, is recognized and compensated for by a piston motion toward end wall 21, reducing the size of expansion chamber 32 and maintaining pressure on the reduced volume of liquid therein. A rising liquid temperature, leading to a less dense liquid condition, is recognized and compensated for by a piston motion away from end wall 21, increasing the size of expansion chamber 32 while maintaining a pressure on the larger volume of liquid therein. The system is designed to be operative over a wide range of temperatures, as for example from −65° F. to +160° F. At the low temperature extreme, the reservoir piston 25 assumes a position substantially as shown in FIG. 2. At the high temperature extreme, the reservoir piston assumes a position substantially as shown in FIG. 3.

The reservoir construction is one placing large and small piston areas in opposition to one another. In accordance with the invention concept, the large piston area is supplemented by a small piston area represented by flange 29. The low pressure liquid in expansion chamber 32 is communicated to annular chamber 34, by way of passageway 24, where it reacts on annulus 23 and presses upon flange 29 in a direction to assist the low pressure in chamber 32 in opposing the pressure in high pressure chamber 33. For given design conditions, that is, volume change, pump pressure rise and pump suction pressure, and given cylinder diameter, the overall length of the reservoir device is minimized by the supplemental low pressure chamber 34. Further, the construction places the high pressure chamber 33 between two low pressure chambers, that is, between chambers 32 and 34. Leakage control is greatly enhanced thereby since any high pressure liquid that may escape past seal 35 or seal 36 does not have access to ambient surroundings but instead merely reaches low pressure locations in the system. Chamber 34, since it communicates with the system on the suction side of the pump, is not subject to any pressure rise not easily controlled by seal 37. The arrangement has particular utility in systems having a very low tolerance for leakage. The need for diaphragms to enforce positive sealing is obviated. It makes possible a sliding seal type bootstrap reservoir without elaborate and expensive seals. The several seals 35–37 can, as noted, assume known, conventional forms.

The invention has been disclosed with respect to particular embodiments. Structural modifications have been discussed and these and others obvious to a person skilled in the art to which this invention relates are considered to be within the intent and scope of the invention.

What is claimed is:

1. In a system circulating a liquid coolant or the like under pump pressure, a bootstrap type accumulator-reservoir device of the sliding seal type, including a reservoir cylinder, a piston reciprocable in said cylinder, one end of said cylinder being closed and defining with said piston on one side thereof a first or low pressure chamber, the other end of said cylinder on the other side of said piston communicating with ambient surroundings, means in said cylinder intermediate the ends thereof defining a second or high pressure chamber in which fluid pressure acts on said piston in opposition to fluid pressure in said first chamber, said first chamber communicating with the circulating system on the suction side of the pump therein, said second chamber communicating with the circulating system on the discharge or pressure side of the pump therein, means in said cylinder intermediate said second chamber and the end of said cylinder communicating with ambient surroundings defining a third chamber, said means including a sliding seal between said second and third chambers, and means pressurizing said third chamber as said first chamber is pressurized, said third chamber positioning so that said second chamber can communicate with ambient suroundings through the said other end of said cylinder only through said third chamber.

2. In a system circulating a liquid coolant or the like under pump pressure, a bootstrap type accumulator-reservoir device of the sliding seal type, including a reservoir cylinder, a piston reciprocable in said cylinder, said piston being a hollow cylindrical body closed at one end and open at the other and having radially projecting longitudinally spaced apart piston portions in sliding contact with an inner cylinder wall, the body of said piston between said piston portions being in concentric spaced relation to said cylinder wall, an end of said cylinder adjacent the closed end of said piston being closed to define with the piston an expansion chamber and an end of said cylinder adjacent the open end of said piston being open to ambient surroundings, means on said cylinder projecting between said piston portions and defining therewith and with said piston body longitudinally spaced annular pressure chambers, one of which communicates with the system on the discharge side of the pump therein to apply a pressure to its adjacent piston portion in opposition to the pressure in said expansion chamber and the other of which communicates with the system on the suction side of the pump therein to apply a pressure to its adjacent piston portion supplemental to the pressure applied in the expansion chamber, said projecting means including a sliding seal between said spaced annular chambers, the said other annular chamber positioning between the first said annular chamber and the said open end of said cylinder.

3. A reservoir device according to claim 2, the body portion of said piston having a sliding contact with the said cylinder means projecting between said piston portions and defining to opposite sides thereof reactant surfaces for pressures applied in said annular chambers.

4. A reservoir device according to claim 3, said piston portions and said projecting means having seals set therein for controlling pressure leakage, the arrangement of said chambers permitting direct leakage from a high pressure area as represented by the said one annular chamber to take place only to lower pressure areas as represented by said expansion chamber and the said other annular chamber.

5. A reservoir device according to claim 4, and means defining a continuously open passage between said expansion chamber and said other annular chamber.

* * * * *